US008094078B2

(12) United States Patent
Huang

(10) Patent No.: US 8,094,078 B2
(45) Date of Patent: Jan. 10, 2012

(54) MONOPOLE ANTENNA

(75) Inventor: Chang-Ching Huang, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 455 days.

(21) Appl. No.: 12/401,728

(22) Filed: Mar. 11, 2009

(65) Prior Publication Data

US 2010/0123638 A1 May 20, 2010

(30) Foreign Application Priority Data

Nov. 18, 2008 (CN) ..... 2008 1 0305618

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

2004/0233109 A1* 11/2004 Ying et al. ..... 343/700 MS
2006/0262016 A1* 11/2006 Hung et al. ..... 343/702
2009/0109097 A1* 4/2009 Peng et al. ..... 343/700 MS
2010/0117907 A1* 5/2010 Su et al. ..... 343/700 MS

* cited by examiner

*Primary Examiner* — Hoanganh Le
(74) *Attorney, Agent, or Firm* — Altis Law Group, Inc.

(57) ABSTRACT

The invention discloses a monopole antenna for assembly within a wireless communication device to transmit and exchange data signals. The monopole antenna includes a main body, a feed portion, a grounding portion, a first transmitting body and a second transmitting body. The feed portion and the grounding portion are disposed on the main body. A first transmitting body is a high frequency path extending outwardly from the main body and a second transmitting body is a low frequency path extending outwardly from the main body.

11 Claims, 6 Drawing Sheets

MONOPOLE ANTENNA

BACKGROUND

1. Technical Field

The present invention generally relates to an antenna, particularly to a monopole antenna assembled within a portable wireless communication device.

2. Discussion of the Related Art

With the developments of wireless communication and information processing technologies, portable wireless communication devices such as mobile phones and personal digital assistants (PDAs) are now in widely use, and consumers may now enjoy the full convenience of high products almost anytime and anywhere.

Typical portable wireless communication device generally includes an antenna assembled therein to transmit and receive electromagnetic waves for transmitting and exchanging signals and datum. With the life cycle and the development time of a portable wireless communication device becoming shorter and shorter, monopole antennas are widely used in portable wireless communication devices. However, the typical monopole antenna is hard to adjust and is not universal for different portable wireless communication devices.

Therefore, there is room for improvement within the art.

BRIEF DESCRIPTION OF THE DRAWING

Many aspects of the present monopole antenna can be better understood with reference to the following drawings. The components in the drawings are not necessarily drawn to scale, the emphasis instead being placed upon clearly illustrating the principles of the present monopole antenna. Moreover, in the drawings, like reference numerals designate corresponding parts throughout the several views.

DETAILED DESCRIPTION OF THE EMBODIMENT

Figure 1:
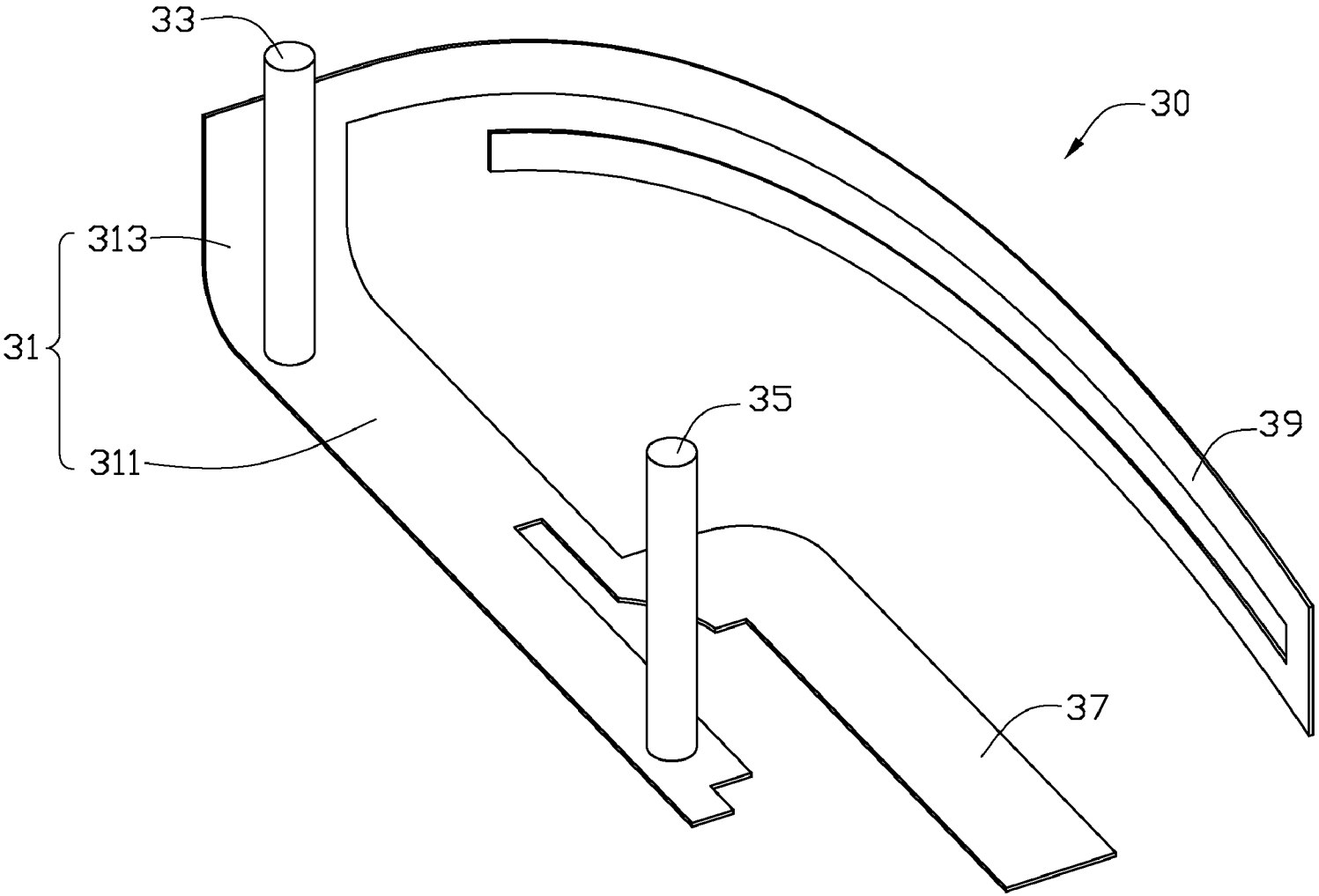
FIG. 1 shows a schematic, perspective view of a monopole antenna, according to the exemplary embodiment.
Figure 2:
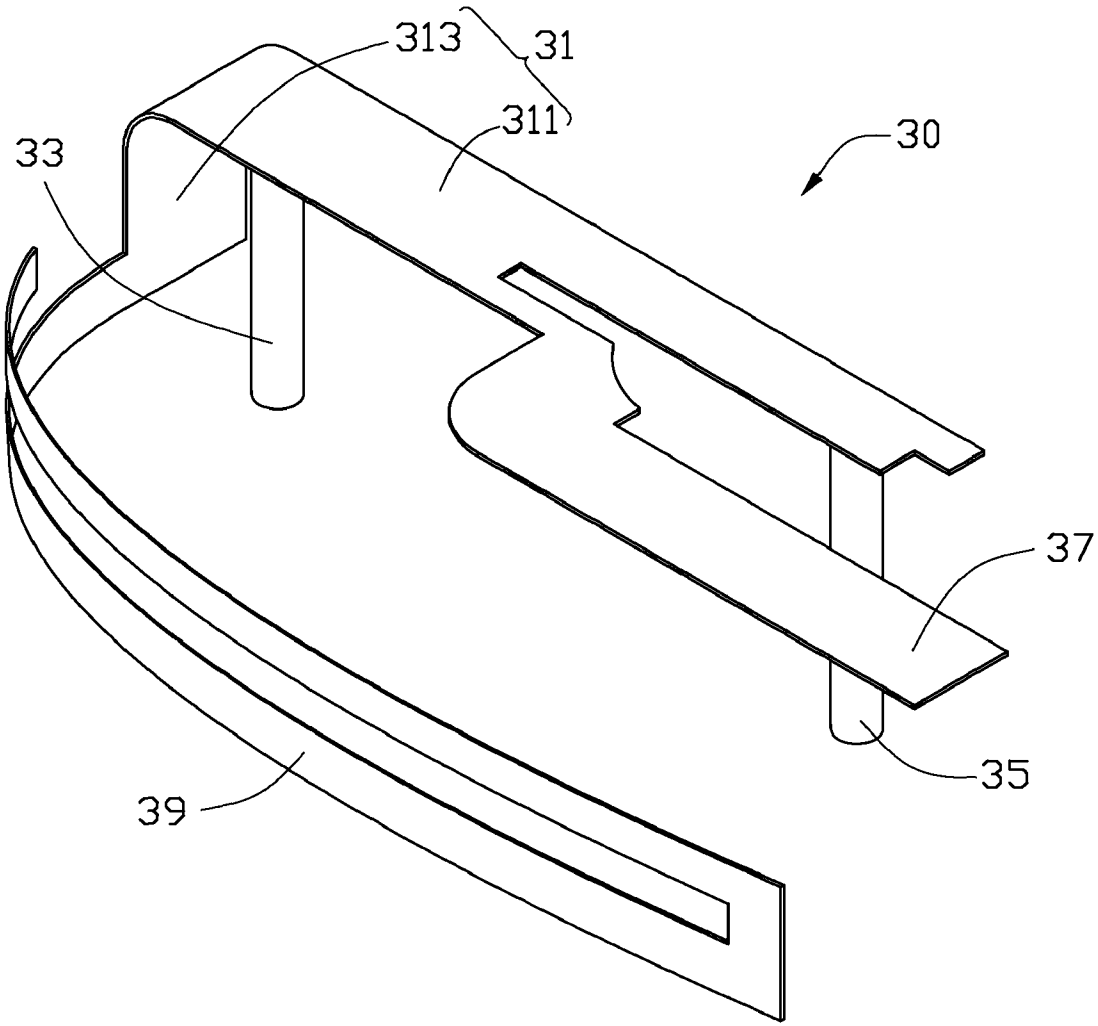
FIG. 2 is similar to FIG. 1, but viewed from another aspect.

The monopole antenna 30 includes a main body 31, a feed portion 33, a grounding portion 35, a first transmitting body 37 and a second transmitting body 39. The main body 31 is a substantially L shaped metal sheet, and includes a base portion 311 and a bent portion 313. The plane of the base portion 311 is substantially perpendicular to the plane of the bent portion 313. The feed portion 33 and the grounding portion 35 are both substantially cylindrical in shape, and are disposed at opposite ends of the same surface of the base portion 311. A distance between the feed portion 33 and the grounding portion 35 may vary according to actual needs, to make the monopole antenna 30 work under different wireless communicating systems. A preferred distance between the feed portion 33 and the grounding portion 35 is from ¼λg of the GSM communicating system to ½λg of the DCS or PCS communicating system, wherein λg=(C/4f), wherein C is velocity of light, f is the working frequency.

The first transmitting body 37 forms a high frequency transmission path, and is substantially an L-shaped sheet extending from a middle portion of the base portion 311 along a direction away from the bent portion 313. The first transmitting body 37 is at the same plane as the base portion 311 of the main body 31. In usage, the impedance matching of the monopole antenna 30 can be set by adjusting the distance between the feed portion 33 and the grounding portion 35. The second transmitting body 39 forms a low frequency transmission path, and is substantially a U-shaped sheet extending outwards from a distal end of the bent portion 313 towards the first transmitting body 37. The second transmitting body 39 is on the same side of the base portion 311 as first transmitting body 37 and also lies in a plane that is perpendicular to the plane of the base portion 311 of the main body 31.

The monopole antenna 30 can be widely used in portable wireless communication devices such as mobile phones and personal digital assistants (PDAs) to make the portable wireless communication device work under different communication systems with different frequencies. When the monopole antenna 30 is in use, the signal feed portion 33 receives the outer radio frequency signals and transmit the signals from the first transmitting body 37 and the second transmitting body 39. The first transmitting body 37 and the second transmitting body 39 form the different transmit paths with different lengths and obtain the different high frequency signals and the low frequency signals, respectively, to generate different operating frequencies to make the monopole antenna 20 work under GSM, DCS and PCS three communication systems.

Figure 3:
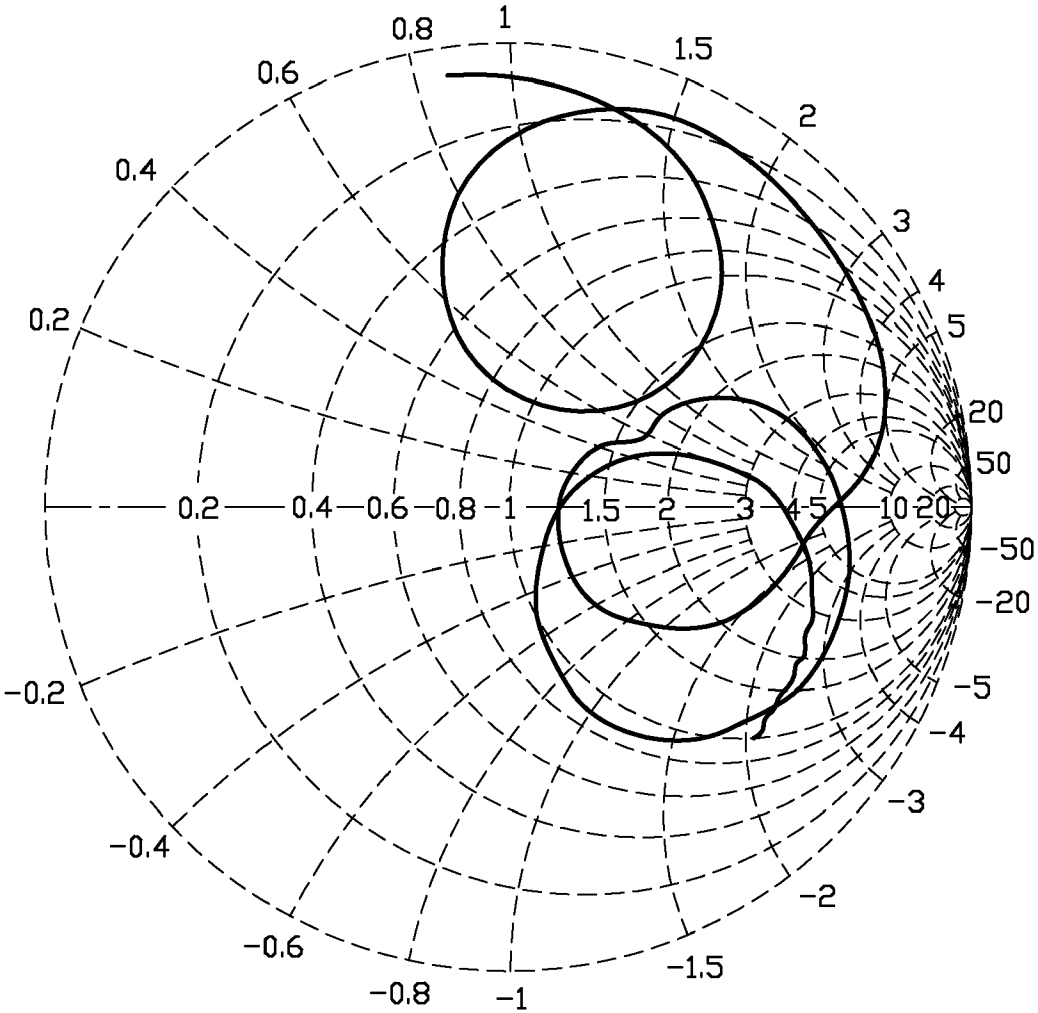
FIG. 3 shows test graph of a radiation directional pattern of the monopole antenna with a distance between a feed portion and a grounding portion is 14 mm.
Figure 4:
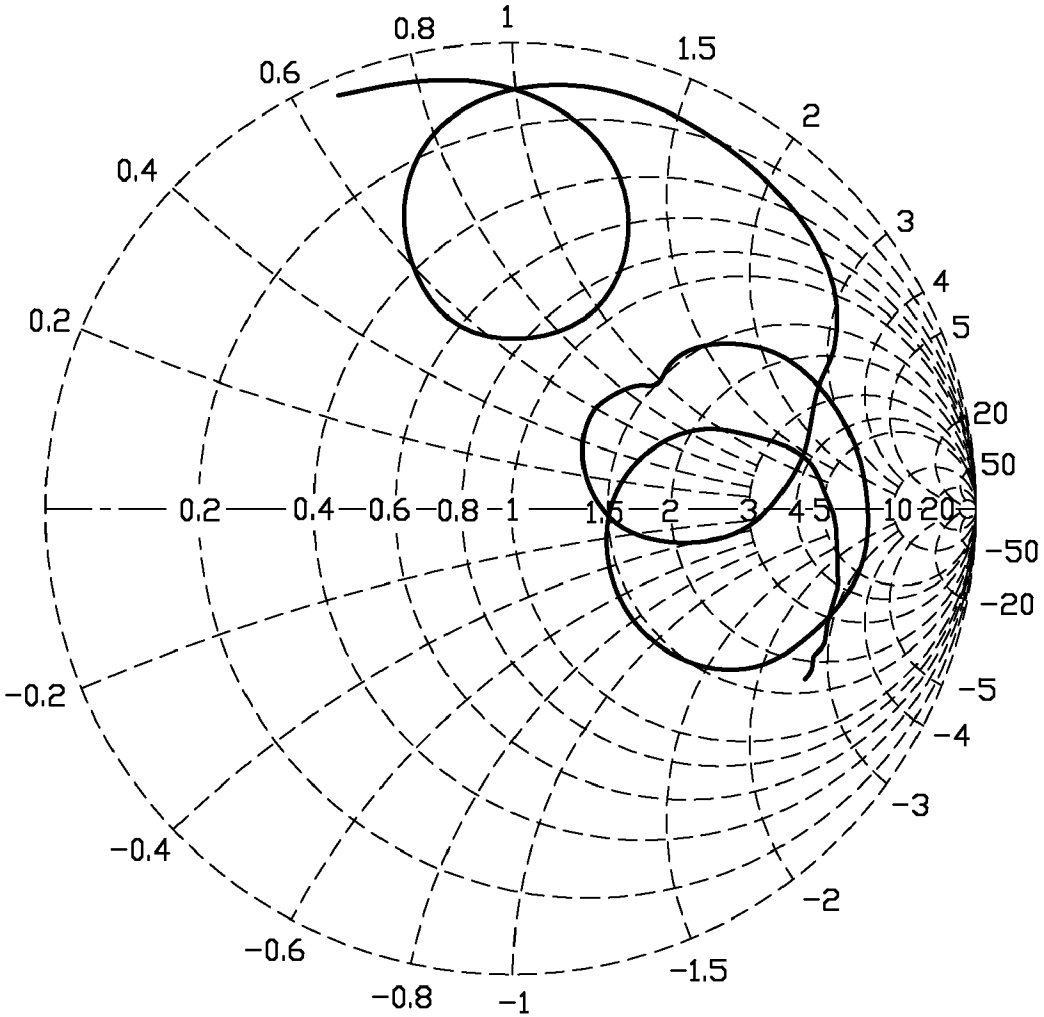
FIG. 4 shows test graph of a radiation directional pattern of the monopole antenna with a distance between a feed portion and a grounding portion is 10.5 mm.
Figure 5:
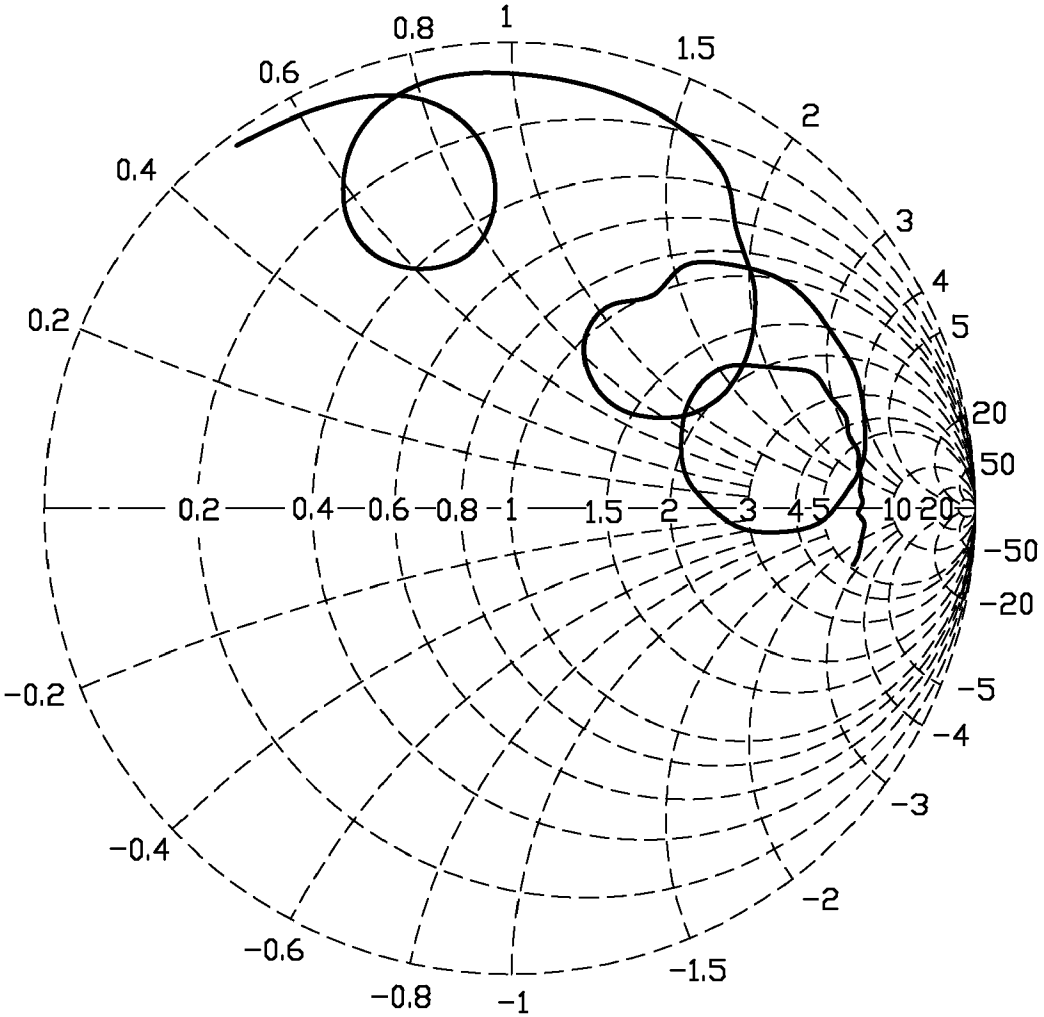
FIG. 5 shows test graph of a radiation directional pattern of the monopole antenna with a distance between a feed portion and a grounding portion is 7 mm.
Figure 6:
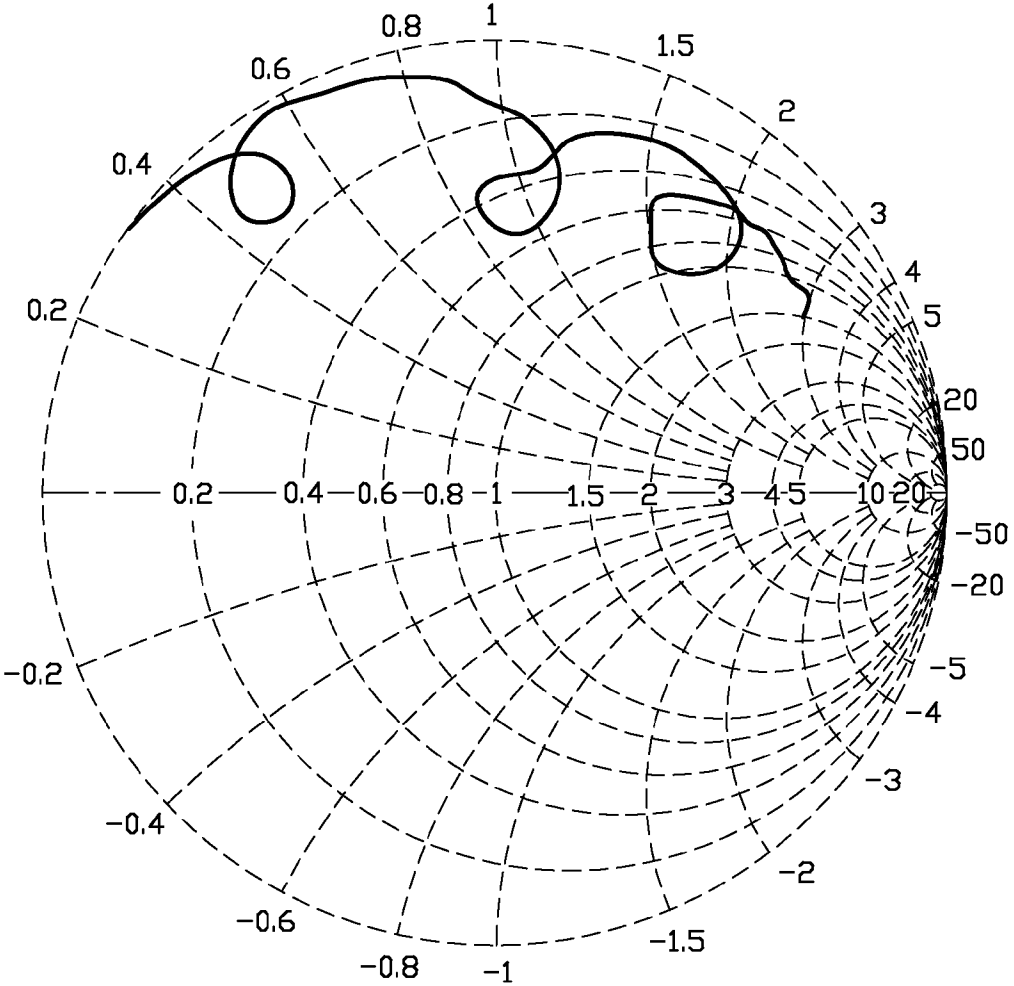
FIG. 6 shows test graph of a radiation directional pattern of the monopole antenna with a distance between a feed portion and a grounding portion is 3.5 mm.

FIGS. 3-6 show the radiation directional patterns of the monopole antenna 30 when the distance between the feed portion 33 and grounding portion 39 is 14 mm, 10.5 mm, 7 mm and 3.5 mm, respectively. The measured results of the diagrams show that the bandwidth of the monopole antenna 30 covers the GSM, DCS and PCS communication systems. As the distance between the feed-in portion 37 and the grounding portion 39 becomes smaller, the bandwidth of the monopole antenna 30 becomes smaller too.

Finally, it is to be understood, however, that even though numerous characteristics and advantages of the present invention have been set forth in the foregoing description, together with details of the structure and function of the present invention, the disclosure is illustrative only, and changes may be made in detail, especially in matters of shape, size, and arrangement of parts within the principles of present invention to the full extent indicated by the broad general meaning of the terms in which the appended claims are expressed.

What is claimed is:

1. A monopole antenna comprising:

a main body being an L-shaped sheet and including a base portion and a bent portion, the feed portion and the grounding portion being disposed at opposite ends of the same surface of the base portion;

a feed portion and a grounding portion disposed on the main body;

a first transmitting body, forming a high frequency transmission path, extending outwardly from the main body; and a second transmitting body, forming a low frequency transmission path, extending outwardly from the main body, and lying along a plane substantially perpendicular to a plane of the first transmitting body.

2. The monopole antenna as claimed in claim 1, wherein the first transmitting body is an L-shaped sheet extending outwardly from the middle portion of the base portion and away from the bent portion, the first transmitting body is at the same plane as the base portion.

3. The monopole antenna as claimed in claim 2, wherein the second transmitting body is a U-shaped sheet extending outwardly from the distal end of the bent portion towards the first transmitting body and on the same side of the base portion as first transmitting body.

4. The monopole antenna as claimed in claim 3, wherein the second transmitting body lies in a plane that is perpendicular to the plane of the base portion of the main body.

5. The monopole antenna as claimed in claim 3, wherein the distance between the feed portion and the grounding portion is from $\frac{1}{4}\lambda g$ to $\frac{1}{2}\lambda g$.

6. The monopole antenna as claimed in claim 1, wherein the feed portion and the grounding portion are both substantially cylindrical in shape.

7. A monopole antenna comprising:

a main body being an L-shaped sheet and including a base portion and a bent portion, the feed portion and the grounding portion being disposed at opposite ends of the same surface of the base portion;

a feed portion and a grounding portion disposed on the main body with changeable distance there between to make the monopole antenna work under different wireless communicating systems;

a first transmitting body, forming a high frequency transmission path, extending outwardly from the main body; and a second transmitting body, forming a low frequency transmission path, extending outwardly from the main body, and lying along a plane substantially perpendicular to a plane of the first transmitting body.

8. The monopole antenna as claimed in claim 7, wherein the first transmitting body is an L-shaped sheet extending outwardly from the middle portion of the base portion and away from the bent portion, the first transmitting body is at the same plane as the base portion.

9. The monopole antenna as claimed in claim 7, wherein the second transmitting body is a U-shaped sheet extending outwardly from the distal end of the bent portion towards the first transmitting body and on the same side of the base portion as first transmitting body.

10. The monopole antenna as claimed in claim 9, wherein the second transmitting body lies in a plane that is perpendicular to the plane of the base portion of the main body.

11. The monopole antenna as claimed in claim 7, wherein the distance between the feed portion and the grounding portion is changeable.

* * * * *